US005846062A

United States Patent [19]

Yanagisawa et al.

[11] Patent Number: 5,846,062

[45] Date of Patent: Dec. 8, 1998

[54] TWO STAGE SCREW TYPE VACUUM PUMP WITH MOTOR IN-BETWEEN THE STAGES

[75] Inventors: Kiyoshi Yanagisawa; Kozo Matake, both of Kawasaki; Yoshinori Ojima, Kamakura; Yasushi Hisabe, Samukawa-machi, all of Japan

[73] Assignee: Ebara Corporation, Tokyo, Japan

[21] Appl. No.: 867,047

[22] Filed: Jun. 2, 1997

[30] Foreign Application Priority Data

Jun. 3, 1996 [JP] Japan ..... 8-162401

[51] Int. Cl.[6] ..... F04B 17/00; F01C 11/00; F04C 2/00; F04C 11/00; F04C 23/00

[52] U.S. Cl. ..... 417/410.4; 417/252; 417/42; 417/45; 418/9

[58] Field of Search ..... 417/252, 350, 417/410.4, 42, 45; 418/9

[56] References Cited

U.S. PATENT DOCUMENTS

| | | | |
|---|---|---|---|
| 1,756,343 | 4/1930 | Charavay | 417/350 |
| 3,184,155 | 5/1965 | Crooks | 230/139 |
| 3,667,874 | 6/1972 | Weatherston et al. | 418/9 |
| 4,505,647 | 3/1985 | Alloca et al. | 417/252 |
| 5,314,312 | 5/1994 | Ikemoto et al. | 417/16 |
| 5,364,245 | 11/1994 | Kriehn et al. | 418/9 |
| 5,709,537 | 1/1998 | Maruyama et al. | 417/410.4 |
| 5,736,823 | 4/1998 | Nordby et al. | 318/432 |

FOREIGN PATENT DOCUMENTS

| | | |
|---|---|---|
| 63-36086 | 2/1988 | Japan . |
| 3-111690 | 5/1991 | Japan . |
| 7-317673 | 12/1995 | Japan . |

*Primary Examiner*—Timothy Thorpe
*Assistant Examiner*—Ehud Gartenberg
*Attorney, Agent, or Firm*—Oblon, Spivak, McClelland, Maier & Neustadt, P.C.

[57] ABSTRACT

A screw type dry vacuum pump having dual shafts is disclosed, whereby the process gas is transported through three compartments, a gas admittance pump section, a central drive motor section, and a gas discharge pump section. By placing the drive motor in the center of the pump, it becomes possible to design a pump having the dual shafts supported only at one end, thus enabling to mount the rotors at the free ends of the pump which are closed with end plates which can be removed easily for servicing the pump sections. Synchronous operation of the dual shaft pump by magnetic coupling enables to lower power consumption and to extend the range of operable pressures.

9 Claims, 8 Drawing Sheets

TWO STAGE SCREW TYPE VACUUM PUMP WITH MOTOR IN-BETWEEN THE STAGES

BACKGROUND OF THE INVENTION

1. Field of the Invention

The present invention relates in general to vacuum pumps for use, for example, in semiconductor industries, and particularly relates to a displacement type dry pump which can exhaust a gas from an atmospheric pressure, and can attain a vacuum in a range from $10^{-4}$ torr to several torr.

2. Description of the Prior Art

Vacuum pumps used in semiconductor industries to exhaust process gases from a processing chamber must be dry types which do not rely on the use of oil in their internal passages so as to maintain a clean processing environment. The vacuum pumps may be displacement pumps which have dual shafts, and the rotor configuration can be either a root type or a screw type.

FIG. 8 shows one type of screw type vacuum pump having dual shafts. The pump comprises a casing 100 which houses two parallel shafts 101, 102, which have screw rotors 103, 104 having screw threads for mating with each other. One of the shaft 101 is rotated by a motor 105, and the rotating force is transmitted to the other shaft 102 through a gear 106 attached to the opposite end of the shaft 101. By rotating the screw rotors 103, 104 in synchronization in opposite directions with each other, a gas trapped in the space formed by the casing 100 and screw rotors 103, 104 is transported in the axial direction to be exhausted by mating screw threads.

Such a pump is simple in structure and its basic function is to move a certain volume of gas, which is trapped in the casing, by the rotary action of the rotors 103, 104, but it does not have a gas compressing function, therefore, if the exhausting process relies only on a single-stage pump, it presents a problem that the power consumption per unit volume of discharged gas is rather high.

To resolve such a difficulty, pumps of different exhausting capacities may be combined in such a way that a large capacity pump is placed on the gas admittance side (at low pressure side) and a smaller capacity pump on the gas discharge side (at atmospheric pressure side). In this case, a consideration may be given to two kinds of systems. One system is provided with a combination of two separate pumps which have driving mechanism in each pump. The other system is a combination of two screw rotors which are attached on the common drive shaft.

When two different pumps are to be combined, two driving mechanisms are necessary and consequently the space and cost requirements would be high, and the power consumption also would be risen. It is also necessary to provide interconnecting pipes for the two pumps, and if the temperatures of the pipes decreases, reaction particles may be deposited from the process gases used for semiconductor processing (for example, etching, chemical vapor deposition, sputtering, and evaporation) on the interior walls of the pipe, requiring frequent system maintenance work.

On the other hand, if two rotors are attached to one driving source, the two rotors must rotate at one speed, and although this configuration presents no problems during the steady state operation. However, when starting of exhaustion of atmospheric pressure gas from the processing chamber, difficulty is experienced at the low pressure side of the system, because of a back pressure generated by the compression of the gas within the pump which is at an atmospheric pressure side. Therefore, a high driving power is essentially required. Another problem happens, if two types of pumps are placed on one drive shaft, the length of the rotors to produce adequate pump performance would be long, then it is difficult to support the rotors at one end only. If the rotors are placed between end supporting bearings, it becomes laborious to service the pumps and could lead to poor maintainability. Also, the end bearings on the vacuum side of the pump system pose a potential contamination problem to the processing chamber, due to the possibility of volatile vapors from the grease back streaming into the processing chamber.

SUMMARY OF THE INVENTION

It is therefore an object of the present invention to provide a compact and efficient dry type vacuum pump that facilitates maintenance work, and able to be operated at a low power consumption per unit volume of discharged gas. Another object of the present invention is to provide a dry type pump to enable to select pump operating parameters such as operating temperatures and discharge volumes, when reaction products are deposited during exhausting a process gas, or on the applicability of utility facilities such as cooling water. Such a pump would provide small compact size, long service life and lower energy consumption.

According to the present invention, there is provided a displacement type vacuum pump, having a pair of parallel drive shafts rotating in opposite directions within a casing, and a pair of screw rotors having screw threads thereon mounted on each of said drive shafts, said screw threads mating with each other for transporting and exhausting a gas trapped in a space formed by the casing, comprising: first pump section having a pair of drive shafts rotating in opposite directions within first casing, and a pair of screw rotors having screw threads thereon mounted on each of the drive shafts, the screw threads mating with each other for transporting and exhausting a gas trapped in the first casing; second pump section having a pair of drive shafts rotating in opposite directions within second casing, and a pair of screw rotors having screw threads thereon mounted on each of said drive shafts, the screw threads mating with each other for transporting and exhausting a gas trapped in the second casing; and a motor section mounted between said first pump section and said second pump section for driving said pair of drive shafts of the first pump section and the second pump section.

Accordingly, both screw rotors of both pump sections can be made short length enabling a cantilever support. This structure of the pump makes the dual shaft screw type vacuum pump simple and promotes easy maintenance. This structure also permits support bearings to be placed on the inside region of the pump, thus minimizing volatile components in the lubricating grease to back stream into the vacuum side of the pump. Also, the bearings are placed away from the discharge side of the pump, especially from the second pump section, so as to keep their temperature low.

An aspect of the present invention is to provide a displacement type vacuum pump that the drive shaft is supported by bearings mounted between the motor section and the pump section for supporting the screw rotor in a contileveler manner, according maintainability of the pump is improved.

Another aspect of the present invention is to provide a displacement type vacuum pump that the first pump section has an exhaust capacity which is higher than an exhaust capacity of the second pump section, accordingly, in a low pressure range of gas admittance pressure, the power consumption per unit volume of exhausted gas becomes low.

Another aspect of the present invention is to provide a displacement type vacuum pump that the displacement type vacuum pump does not use a lubricating oil for lubricating the bearings, accordingly, potential sources of contamination are reduced.

Another aspect of the present invention is to provide a displacement type vacuum pump that a pair of drive shafts are magnetically coupled and rotated synchronously with each other.

Another aspect of the present invention is to provide a displacement type vacuum pump that a gas flow passage is provided inside of the motor section for transporting an exhausted gas from the first pump section to the second pump section. Accordingly, the pump is made compact and also offers an advantage of enabling to provide heat generated in the windings to the gas passage.

Another aspect of the present invention is to provide a displacement type vacuum pump that a gas flow passage is provided outside of the motor section for transporting an exhausted gas from the first pump section to the second pump section. Accordingly, control of the temperature of the gas passage and maintenance work are facilitated.

Another aspect of the present invention is to provide a displacement type vacuum pump that a bypass passage is provided for relieving a pressure rise by directing a gas from an inlet of the second pump section to a gas discharge port thereof when an inlet pressure of the second pump section exceeds an outlet pressure thereof. Accordingly, when operating in a high pressure range of the gas admittance pressure, it enables to avoid increasing the internal pressure in the pump thereby enabling to reduce the required torque on the rotors.

Another aspect of the present invention is to provide a displacement type vacuum pump that a control means is provided therewith for reducing rotation speed of the drive shafts so as to keep power consumption substantially constant, when pressure becomes too high to exceed torque ratings of the motor section. Accordingly, it enables to maintain the power consumption substantially constant during the startup and steady state phases of the operation of the pump, and avoiding any problems introduced by excessive current flow through the windings.

The above and other objects, features, and advantages of the present invention will become apparent from the following description when taken in conjunction with the accompany drawings which illustrate preferred embodiments of the present inventions by way of example. In the drawings, same or equivalent parts are referred to by the same reference numerals.

DESCRIPTION OF THE PREFERRED EMBODIMENTS

Figure 1:
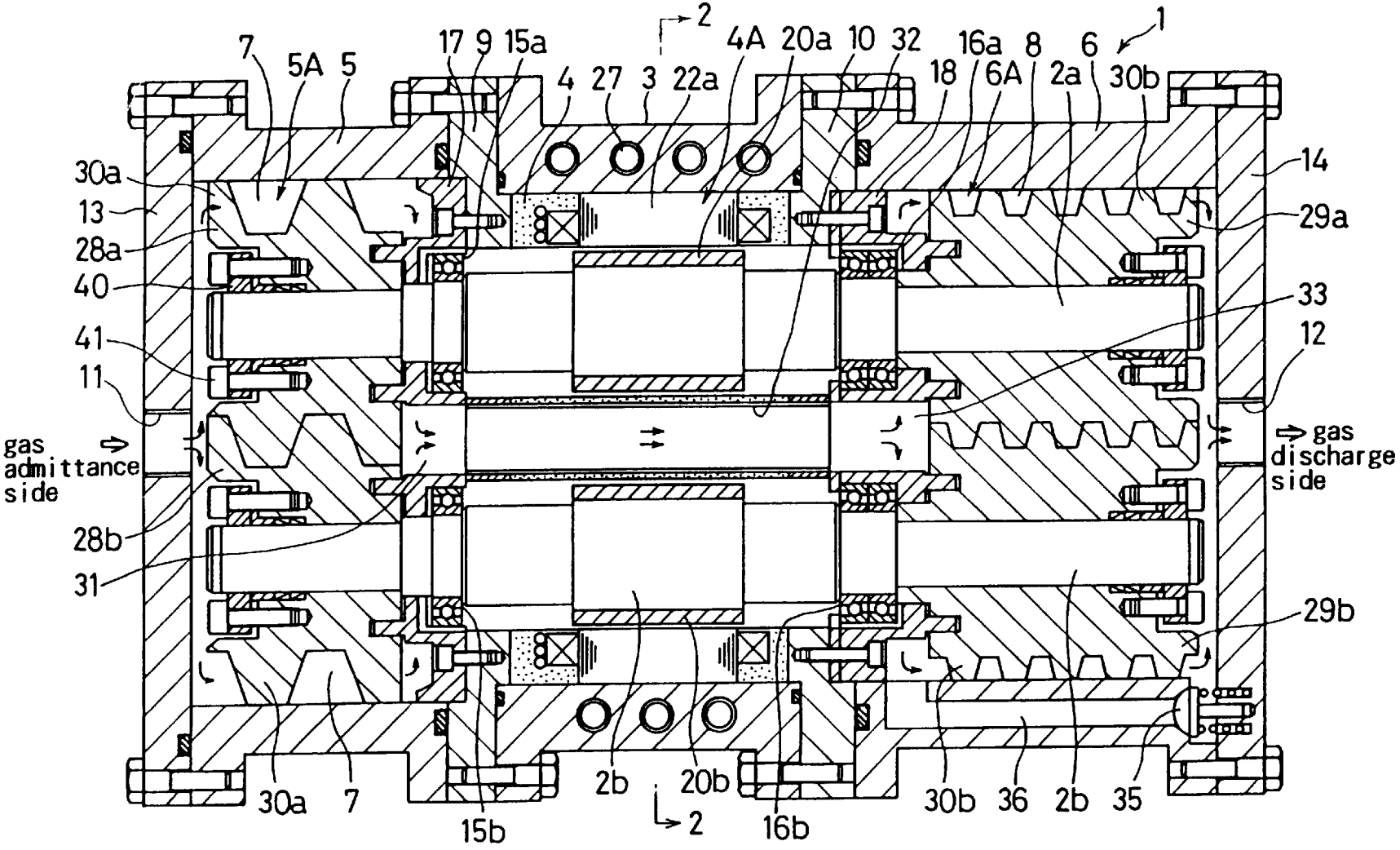
FIG. 1 is a horizontal cross sectional view of a first embodiment of the vacuum pump of the present invention.

The vacuum pump 1 comprises a pair of parallel shafts 2*a*, 2*b* which are disposed within a casing with three separate chambers provided along the longitudinal axis. In the center region of the pump 1, a cylindrical shaped motor casing 3 houses a motor chamber 4. On the left (gas admittance side) and right (gas discharge side) of the motor chamber 4, a first pumping chamber 7, and a second pumping chamber 8 confined by the corresponding pump casings 5, 6, are disposed respectively. Between the motor chamber 4 and the pumping chambers 7, 8, the motorside separation rings 9, 10 are provided therebetween for isolating the pumping chambers 7, 8 from the motor chamber 4. The ends of the pump casings 5, 6 are closed with end covers 13, 14 having a (process) gas admittance port 11 or a (process) gas discharge port 12 provided in the central region.

The shafts 2*a*, 2*b* pass through the three chambers 4, 5 and 6, as described above, and are freely rotatably supported by a pair of bearings (ball bearings) 15*a*, 15*b* on the admittance-side and a pair of bearings (ball bearings) 16*a*, 16*b* on the discharge-side, installed in the corresponding motorside separation rings 9, 10. Each shaft 2*a*, 2*b* is supported at one end, in a so-called cantilever style, and the opposite ends are freely rotatably disposed within the pump chambers 7, 8. Each pair of bearings, 15*a*, 15*b* and 16*a*, 16*b*, are lubricated with grease, and are inserted into the bearing housings 17, 18 which are firmly disposed in the motor-side separation rings 9, 10 of the respective chambers.

Figure 2:
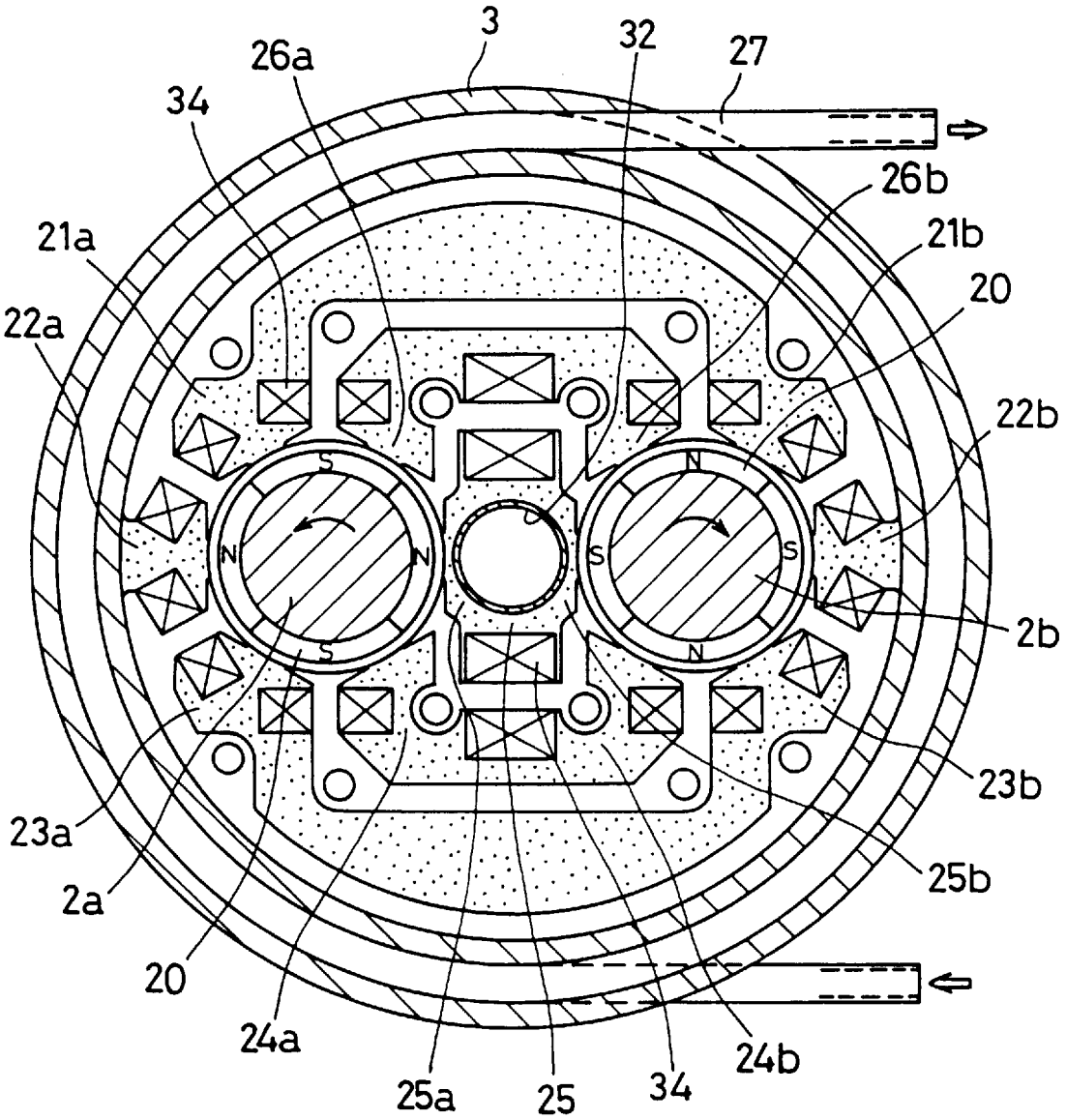
FIG. 2 is a cross sectional view seen at a section along the arrow A in FIG. 1.

The detail of the motor chamber 4 will be described next. Magnets 20*a*, 20*b* are attached on the outer peripheries of each of the shafts 2*a*, 2*b*, and in this case, the magnets 20*a*, 20*b* are provided with alternating four N and S poles, as shown in FIG. 2. The iron core stators 21*a*–26*b* surrounding the magnetic rotors 20*a*, 20*b* are arranged so as to electrically connect at the plane symmetry positions of the two shafts. Thereby it is provided with a synchronous motor M having dual shafts which can rotate synchronously with each other, regardless of whether the motor is powered or not powered.

Figure 3:
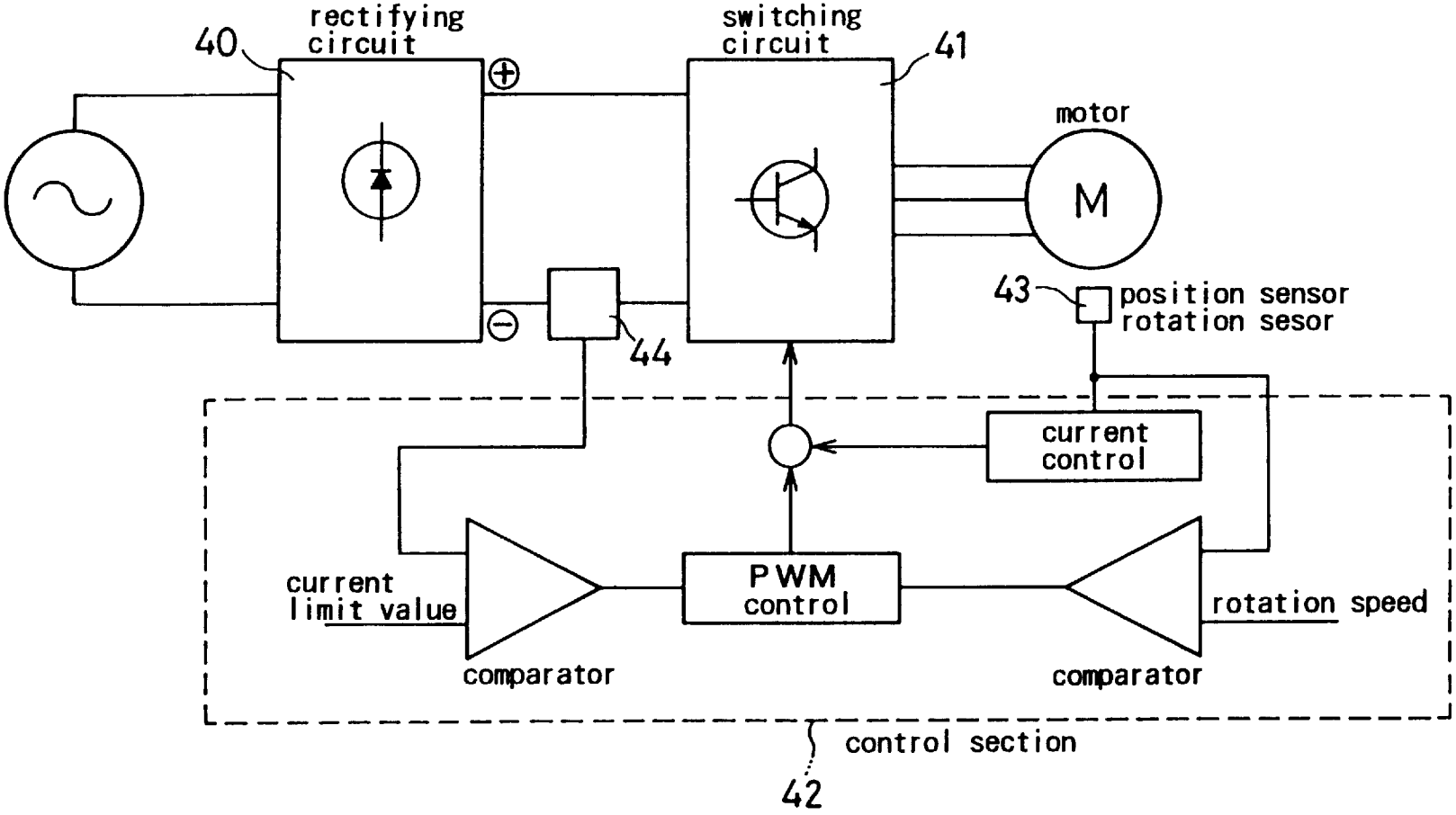
FIG. 3 is a block diagram of the electrical circuit of the vacuum pump.

The motor M is a brushless direct current motor, and to operate this motor M, the a.c. supply power is first rectified, as shown in the block diagram of the electrical circuit given in FIG. 3, and the supply of power to the motor windings is alternated by the switching circuit 41, depending on the angular position of the rotors 20*a*, 20*b*. According to this arrangement, the two shafts 2*a*, 2*b* can rotate in synchronization but in the opposite directions.

In this embodiment, a coolant passage 27 is provided for flowing cooling water in the interior of the motor casing 3, and the water supply pipe communicating with this passage is provided with a flow regulator valve. Almost all of the power input into the vacuum pump is converted into heat generated by the pump motor in compressing the process gas. The torque required to compress the gas is dependent on the pressure difference, but the output torque of the motor is relatively independent of the rotational speed, and so, the heat generated by the pump corresponds to the rotational speed of the pump. Therefore, it is possible to control the temperature of the various sections of the pump to some degree by controlling the rotational speed and the flow rate of the cooling water.

Next, the structure of the pumping sections 5A, 6A shown in FIG. 1 will be described. The interior spaces of the pumping chambers 7, 8 of the respective shafts 2*a,* 2*b* are occupied by screw rotors 28*a,* 28*b* and 29*a,* 29*b* having threads 30*a,* 30*b* (in this case, trapezoidal cross section) machined on their outer peripheries, and are attached to the shaft 2*a,* 2*b* by wedge rings 40 and bolts 41. The threads cut on the rotors themselves are coupled with each other while maintaining minute clearance therebetween, and the outer peripheries of the rotors also maintain some clearance to the pump casings 5, 6. The screw rotors 28*a,* 28*b,* 29*a,* 29*b* and the pump casings 5, 6 constitute a displacement pump.

The shape and size of the screw rotors 30*a,* 30*b* and 28*a*–29*b* for the first pump section 5A and the second pump section 6A are determined as follows. Although the inter-axial distances of the shaft 2*a,* 2*b* in the first pump section 5A and in the second pump section 6A are the same, the exhaust volume from the first pump section 5A is made greater by an amount per one rotation than the second pump section 6A (in this case, 4:1), by selecting the thread pitch, outer diameter and the root diameter appropriately.

The gas outlet port 31 of the first pump section 5A and the gas inlet port 33 of the second pump section 6A are communicated with the gas transport passage 32 provided through the interior section of the motor stator. As seen in FIG. 2, the gas delivery passage 32 is located close to the motor windings 34, and is therefore warmed by the heat given off by the windings while it is operating. Also, a bypass passage 36 having a one-way valve 35 is provided between the inlet port 33 of the second pump section 6A and the discharge port 12, and the one-way valve 35 is set to open when the pressure in the gas inlet port 33 becomes higher than that in the second discharge port 12, by a certain pressure value.

Next, the electrical control circuit (motor driver) of the displacement vacuum pump will be described with reference to the block diagram presented in FIG. 3. The electrical control circuit comprises, a rectifying circuit 40, a switching circuit 41, a power control section 42 for controlling the switching circuit 41, and the power control section 42 alternately governing the rotation speed reference value and the current reference value in accordance with the output signals from the position/rotation sensors 43 provided on the motor M and from the current sensor provided on the power circuit.

Figure 8:
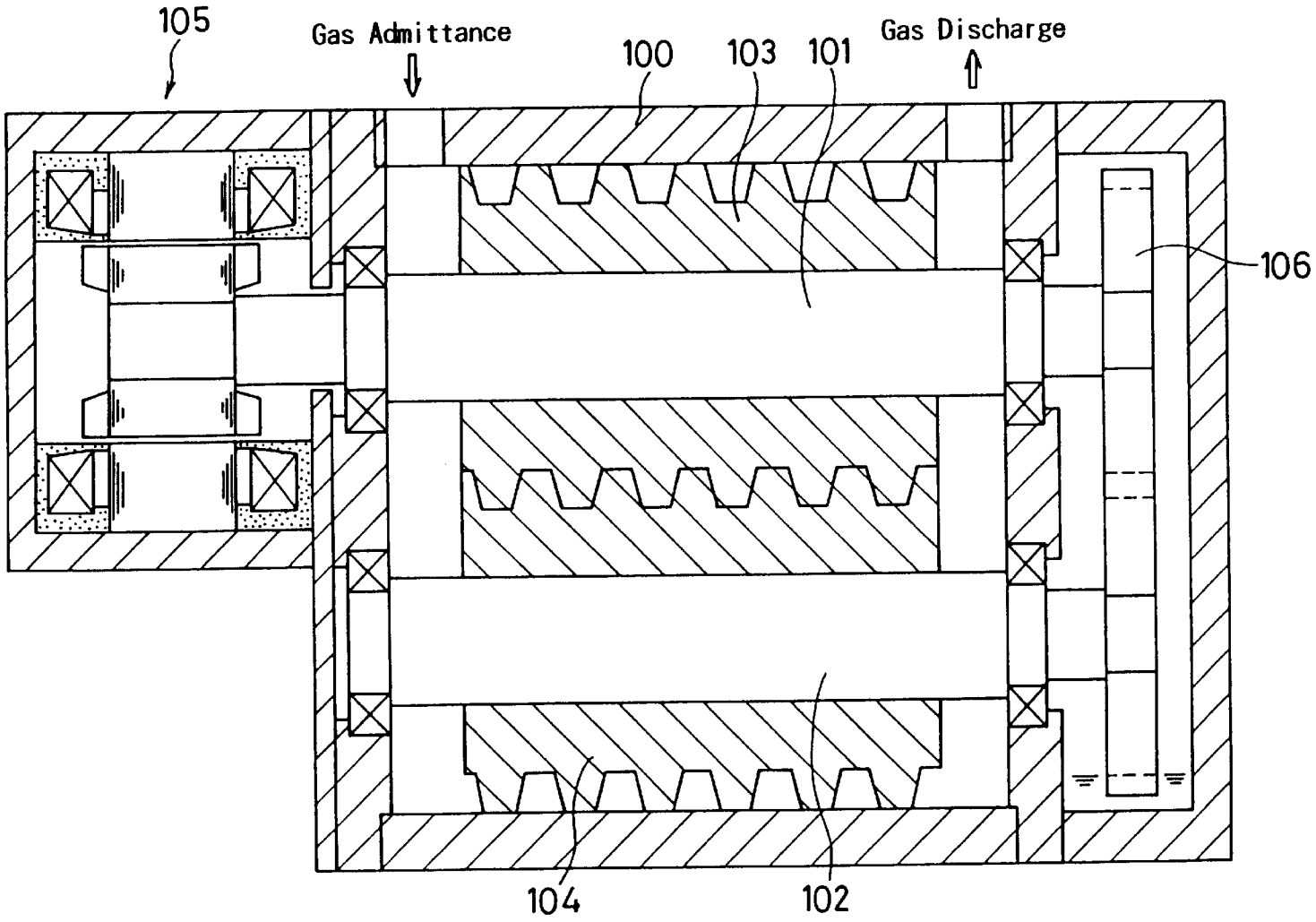
FIG. 8 PRIOR ART
FIG. 8 is a cross sectional view of a conventional screw type vacuum pump.

In this design of the displacement pump, two sets of screw rotors 28*a,* 28*b,* and 29*a,* 29*b* are provided in the axial direction, so that the lengths of each rotor is shorter than the integrated type of design used in the conventional dual shaft pump shown in FIG. 8. Specifically, if the design requires a total of six spirals for a set of screw rotors, by dividing the rotors into two spirals on the inlet side and four spirals on the outlet side, the length of rotors on each side (i.e. vacuum side and the pressure side) can be shortened and yet produce a given degree of vacuum. The short rotors, as illustrated in FIG. 1, produce lesser bending moment and enable to suppress wobbling of the shaft ends to an allowable level, even when the shafts are supported at one end only.

The advantage of the cantilever type support design is the ease of maintenance. Because the rotors 28*a*–29*b* are supported by the bearings 15*a*–16*b* only at an inside end and no bearings are provided at the inlet or outlet side of the pump sections, the pump can be serviced by simply removing the end covers 13, 14 and wedge ring 40 and bolts 41 to take out the screw rotors 28*a*~29*b*. It can be seen that disassembly of the pump becomes simple and maintenance work is facilitated. Because there are no bearings on the gas admittance side to the vacuum pump 5A, it is possible to prevent the volatile components contained in bearing lubricants such as grease to back stream into the vacuum side.

The operation of the pump will be described in the following. When the driving circuit of the motor M is activated, the motor driver device supplies alternating current of a given frequency to the stator coil 34, and the rotating magnetic fields of the stator rotate the pair of rotors 20*a*, 20*b*. In this case, the two shafts 2*a,* 2*b* are magnetically coupled to rotate in opposite directions, thus avoiding the need to differentiate the driver side from the driven side required for a mechanically coupled pump like using gears 106 as shown in FIG. 8. Consequently, the rotation of the rotors becomes smooth and is highly synchronized therebetween.

The rotating shafts 2*a,* 2*b* causes the mating screw rotors 28*a*~29*b* in the pump sections 5A, 6A to rotate, thereby transporting the gas trapped in the spaces. The gas enters through the admittance port 11 of the pump section 5A, and flows into the screw rotors 28*a,* 28*b,* and through the gas outlet port 31 to the gas transport passage 32, and into the inlet port of the second pump 6A from the gas transport passage 32, and is condensed and transported through the screw rotors 29*a,* 29*b,* and exhausted from the gas discharge port 12.

As described earlier, the output volume from the first pump 5A is designed to be greater than that from the second pump 6A, by an amount per one rotation, and during the steady state operation, a relatively high vacuum can be achieved, without increasing the power consumption, even though this is a displacement vacuum pump. However, during the startup period of operation, the pressure difference in the exhaust capacities of the two pumps 5A, 6A causes the pressure in the gas transport delivery passage 32 to be raised. When the pressure at the inlet port of the second pump 6A becomes higher than the gas discharge pressure (normally, an atmospheric pressure), the one-way valve 35 in the bypass passage 36 opens. The gas then bypasses the second pump section 6A, thereby preventing the pressure to be raised beyond a pre-determined value. Therefore, safety is assured and the required torque for driving the first pump section 5A is significantly reduced, and the power consumption is lowered, as shown in FIG. 4.

Figure 5:
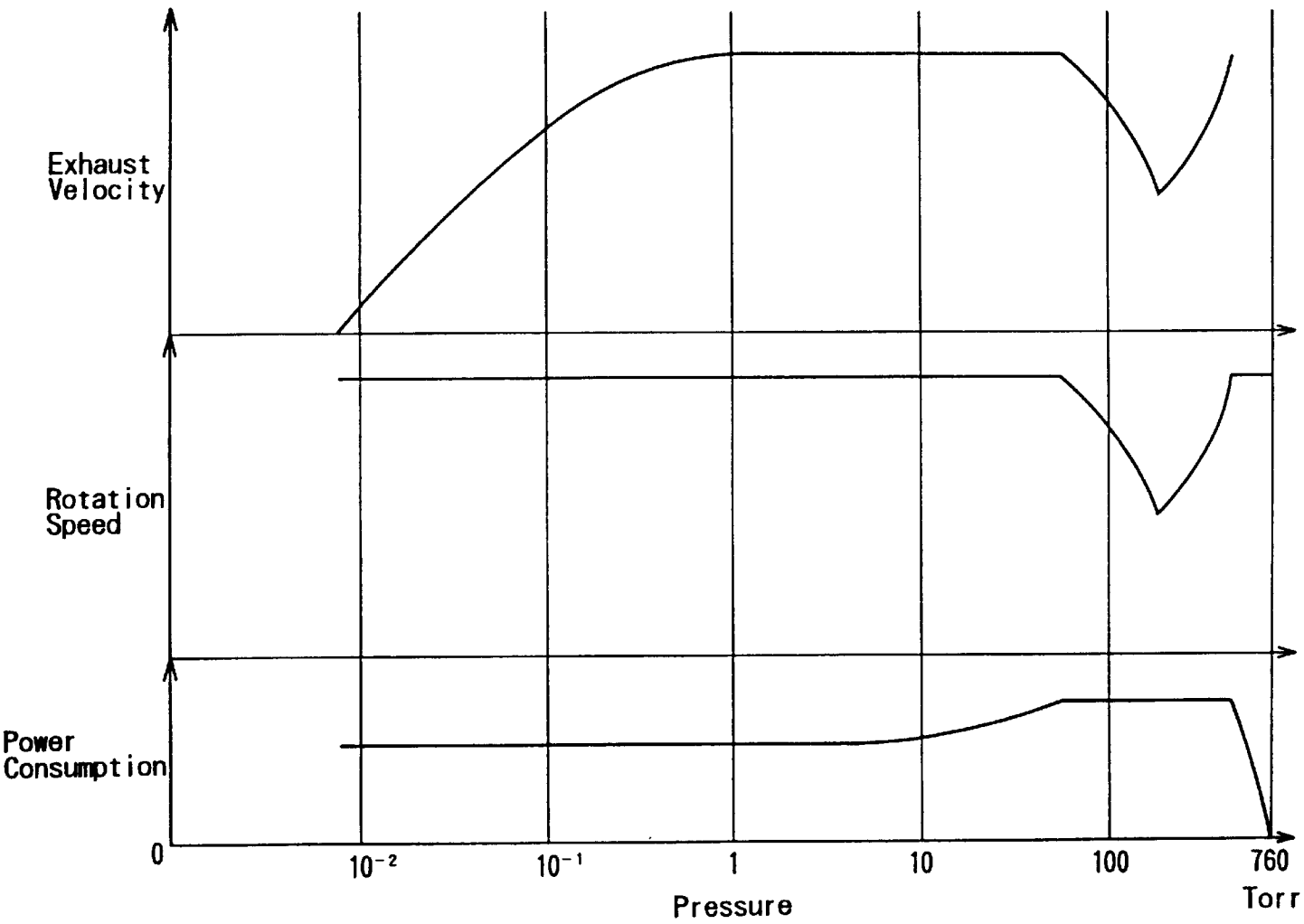
FIG. 5 is a graph showing the exhausting velocity, rotation speed, the power consumption of the vacuum pump.
Figure 6:
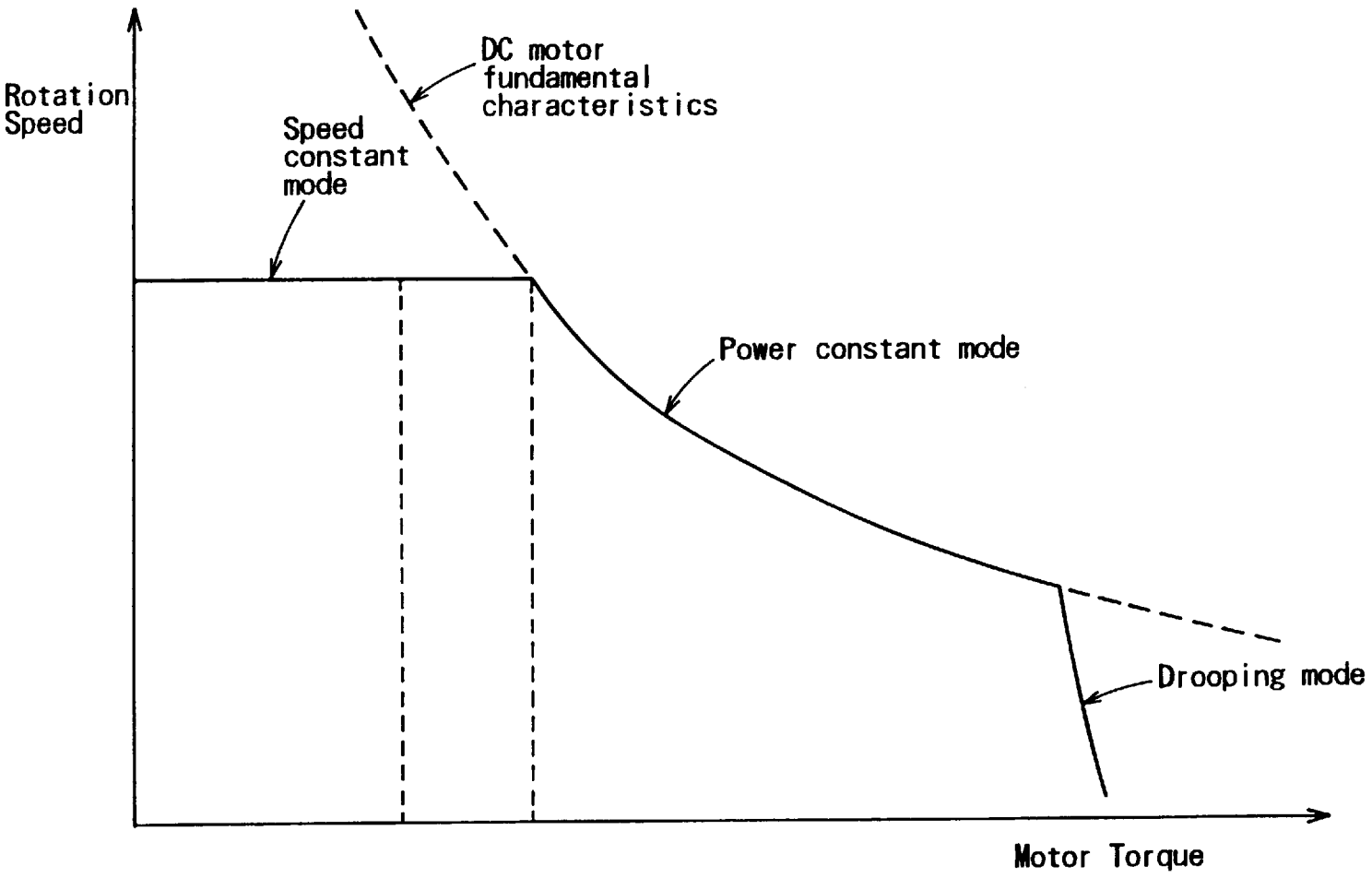
FIG. 6 is a schematic illustration of the operating range of the vacuum pump.

The power control section 42 usually controls the motor M in such a way to maintain a constant rotation speed. However, during the startup period, a higher torque is necessary as mentioned above, and if the controller commands a constant speed, an output torque exceeding the torque rating of the motor is required. To avoid this phenomenon, the controller lowers the speed of the motor, in a operation stage close to atmospheric pressure range, wherein required torque exceeds the torque rating of the motor (refer to the curves in FIG. 5 and 6). Therefore, it becomes possible to operate the pump at all pressure levels under maximum torque ratings of the pump. Although it is possible to lower the rotation speed according to the torque requirement by using the basic dc motor characteristics shown in FIG. 6 directly, however in this embodiment, rotation speed is reduced through the supply voltage control provided by the power control section 42.

Figure 4:
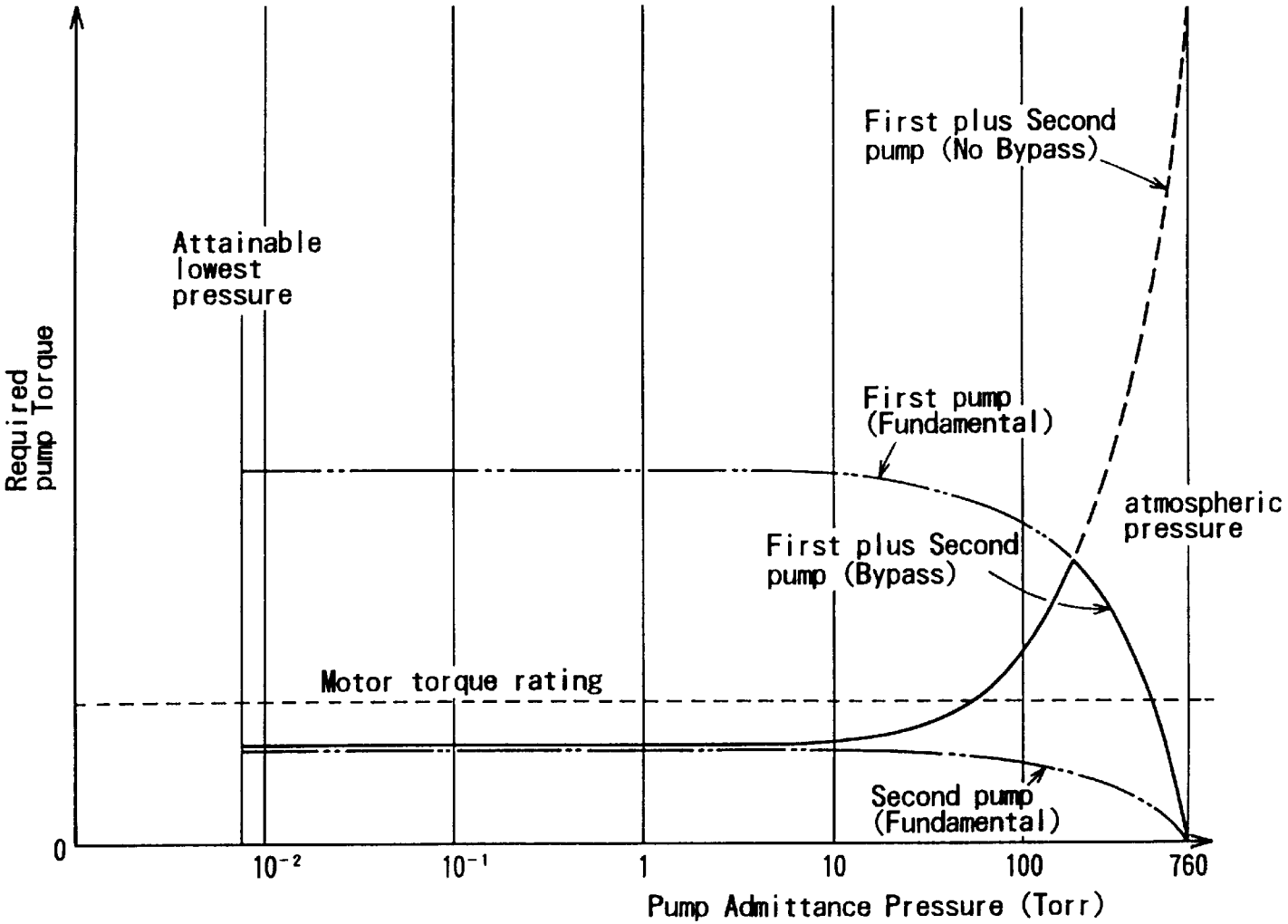
FIG. 4 is a graph showing the torque characteristics at different degrees of vacuum generated by the vacuum pump.

FIG. 4 shows a graph of the basic performance characteristics of the first and second pump section 5A and 6A, separately and in combination with or without the bypass passage. As shown in FIG. 4, it is only possible to utilize the basic performance of each motor directly in a limited range of pressures. At a constant speed of rotation, the double shaft synchronous dc motor can produce higher torque beyond the range of single pumps.

By combining two types of pumps having two different exhaust capacities as demonstrated in this graph, it is possible to handle a large differential pressure during its steady state operation. For example, when the pressure at the admittance port 11 of the first pump section 5A is $10^{-2}$ torr and the gas discharge port 12 of the second pump section 6A is at normal atmosphere pressure, the pressure at the gas outlet port 31 of the first pump section 5A, namely gas inlet port 33 of the second pump section, is in a range of a few torr.

The required torque for the pump rotor depends on the differential pressures existing between the gas admittance port 11 and the gas discharge port 12 than on the rotation speed. However, the effect of the differential pressure at the inlet/outlet of the first pump section 5A for the torque requirement is almost negligibly small, and therefore, as shown in FIG. 4, the required torque is almost same as required torque by the second pump section 6A. Therefore, compared with the torque curves for single pump device, the required power per unit discharge volume to operate the double pump device becomes lower, the result is that the dual stage pump of the present invention consumes less power than the single stage pump as shown in FIG. 8. Furthermore, because the pressure at the gas outlet port 31 (namely, equal to gas inlet port 33 of the second pump section 6A) of the first pump section 5A is only a few torr, the temperature at the vicinity of the bearings is not highly raised by the effect of the gas compression. Therefore it allows the lubricated bearings to be operated stably without the fear of its decomposition by the temperature raise thereof.

The exhaust gas from the first pump section 5A is transported to the inlet of the second pump section 6A through the gas transport passage 32 formed in the interior of the motor stator section. As seen in FIG. 2, the gas transport passage 32 is close to the motor windings 34, and the passage is warmed by the heat generated in the windings. Therefore, those gases which produces reaction product to deposit on the internal surface of the passage at low temperature can be handled by the pump without the fear of causing their decomposition.

Also as shown in FIG. 1 and FIG. 2, the displacement pump is provided with a coolant passage 27 for flowing cold water in the motor frame 3. Most of the power required for operating the vacuum pump is consumed in compressing the gas, and this heat appears to raise the temperature of the pump motor. Because the pump torque is relatively independent of the rotation speed of the screw rotors but is dependent largely of the pressure difference, it is possible to control the amount of heat generation by adjusting the rotational speed of the synchronous motor. Therefore, the temperatures of various parts of the pump can be controlled to some extent by regulating the rotation speed and flow rate of the coolant.

These features of the pump is important especially for the utilization in the field of semiconductor device manufacturing, because the reaction products produced in thin film vapor deposition processes and etching processes are sublimated from vapor phase to solid phase depending on the temperature/pressure conditions existing in the pump. Some of the particles produced in the reaction can deposit on the interior surfaces of the pump rooms to cause deterioration of the performance of the pump. Corrosive gases, if used in etching processes, are passively damaging to the interior surface of the pump rooms, but the corrosive behavior are more critical depending on the temperatures existing inside the pump.

Therefore, it is clear that, the present embodiment of the displacement pump enables to prolong its service life by allowing to select operational variables such as amount of coolant and rotation speed according to the features of the device fabrication process for which the pump is being used.

Figure 7A:
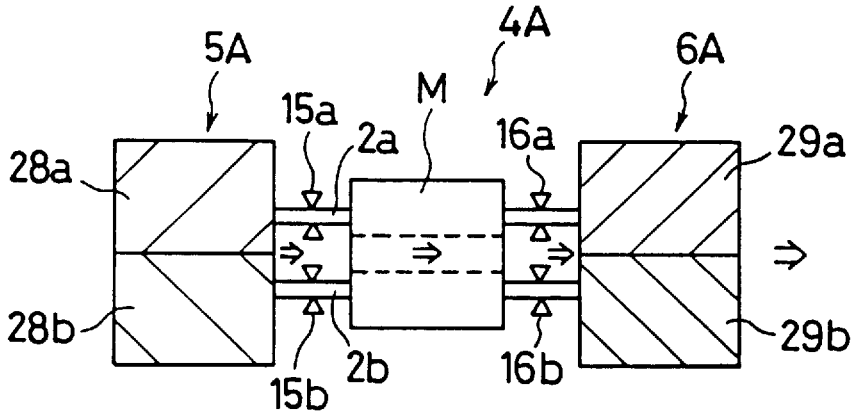
FIG. 7A–7D are schematic representation of other embodiments of the vacuum pump of the present invention.
Figure 7B:
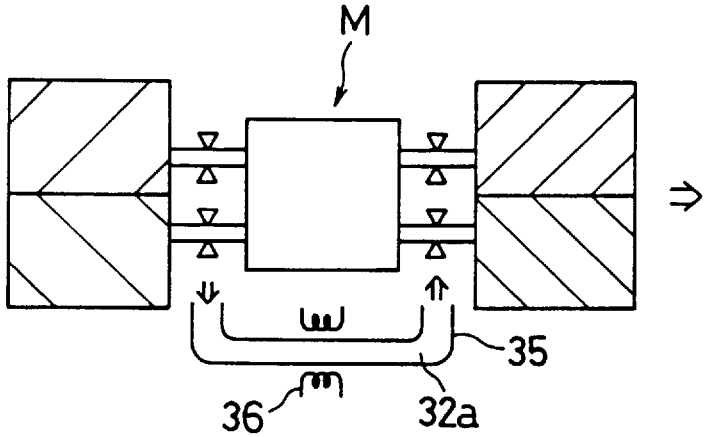
Figure 7C:
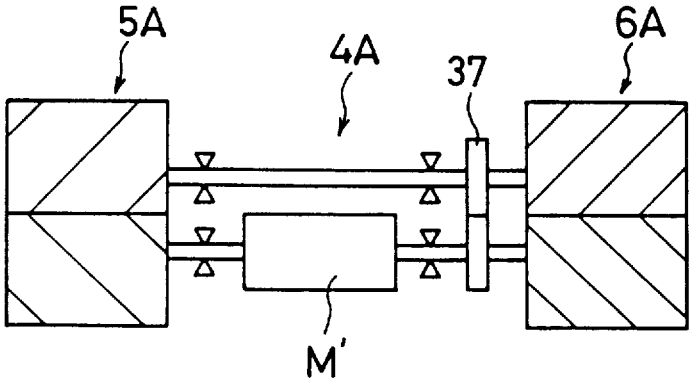

One embodiment of the displacement pump of the present invention has been explained especially with reference to FIG. 1, but the application of the concept is not limited to this particular pump configuration. FIG. 7A through 7D shows various kinds of the embodiments of the present invention. FIG. 7A is a schematic representation of the above-mentioned first embodiment which is corresponding to the pump structure of FIG. 1, and FIGS. 7B~7C are schematic representations of other embodiments of the displacement pump.

In FIG. 7A, the drive source is a synchronous motor located in the motor section M having dual shafts, and the gas delivery passage 32 communicating the two pump sections 5A, 6A are located in the interior of the motor section. FIG. 7B shows the gas passage 32*a,* which is provided within an external piping 35, and a heater 36 may be provided as necessary to heat the external piping 35. Because it is an external connection connecting two pump sections 5A and 6A, it may be easily detached to facilitate maintenance work.

In FIG. 7C, the drive source is a regular single shaft motor M', and a gear arrangement 37 is used to transmit the rotational motion of motor M' from one shaft to the other shaft.

Figure 7D:
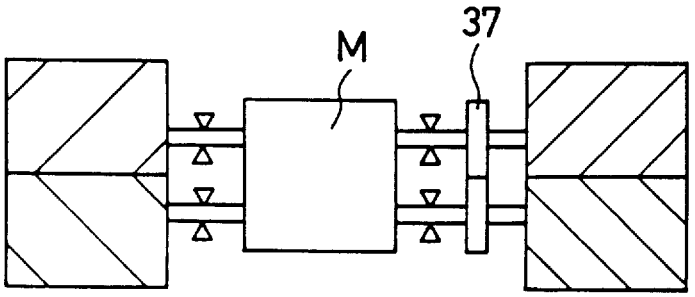

In FIG. 7D, a dual shaft synchronous motor M is combined with a gear arrangement 37 to further improve the synchronicity. In all cases, one drive source is used to operate two pump sections 5A, 6A to achieve a vacuum environment efficiently and at low power consumption. The screw rotors 28*a*~29*b* are supported only at one end, to present a simple construction and ease of maintenance. It should be noted that the configurations shown in FIGS. 7C and 7D are also compatible with either an external or internal arrangement of the gas passages 32, 32*a* as shown in FIGS. 7A and 7B.

It should also be noted that although the previous explanations related to vacuum operations, the embodiments of the pump are equally effective when used as a compressor by having a low pressure on the gas admittance side and a high pressure on the gas discharge side of the pump shown in the embodiments.

The present inventions are summarized as follows:

1. The screw rotors in the dual shaft displacement type vacuum pump are divided into two-stages, gas admittance and gas discharge ports, and the driving motor is arranged in the center section of the overall pump, and the rotors are attached to the free ends of each of the shafts. This configuration enables to gain the following advantages:
   (a) The length of the rotors can be made shorter than those in a conventional single-stage structure, and the cantilever type support of the rotors facilitates access to the rotors for maintenance.
   (b) The bearings (close to the gas admittance end) are distanced away from the vacuum side of the pump so that back streaming of volatile components in the lubricating grease is prevented.
   (c) The bearings (at both ends) are distanced away from the gas discharge side of the pump so that the operating temperature is lowered.

2. The discharge capacity of the intake side of the pump is made higher than that of the outlet side of the pump, so that even in the range of low exhausting pressures, the power consumption per unit volume of discharge is low.
3. The drive motor is a synchronous d.c. motor so that lubricants other than for the bearings are not required.
4. The combination of a bypass passage and a one-way valve enables to prevent the pressure at the inlet to the gas discharge side of the pump not to exceed the pressure at the gas discharge port. Because of this arrangement, the present pump is able to operate in a higher range of pressures, compared with a system not having this arrangement:
   (a) without increasing the internal pressure of the pump, and
   (b) without requiring a larger torque.
5. The gas transport passage to transport exhaust gas from the gas admittance side to the gas discharge side of the pump is formed through the interior of the motor stator so that the gas transport passage can be warmed by the heat of the motor windings.
6. Operating temperature of the pump is controlled by choosing a suitable cooling medium and adjusting the rotation speed of the drive motor.
7. In a pressure range exceeding the torque rating of the drive motor, it is possible to keep the power for the drive motor substantially constant by lowering the rotation speed of the drive motor.

Although a certain preferred embodiment of the present invention has been shown and described in detail, it should be understood that various changes and modifications may be made therein without departing from the scope of the appended claims.

What is claimed is:

1. A displacement type vacuum pump, having a pair of parallel drive shafts rotating in opposite directions within a casing, and a pair of screw rotor having screw threads thereon mounted on each of said drive shafts, said screw threads mating with each other for transporting and exhausting a gas trapped in a space formed by said casing, comprising:

first pump section having a pair of drive shafts rotating in opposite directions within first casing, and a pair of screw rotors having screw threads thereon mounted on each of said drive shafts, said screw threads mating with each other for transporting and exhausting a gas trapped in said first casing;

second pump section having a pair of drive shafts rotating in opposite directions within second casing, and a pair of screw rotors having screw threads thereon mounted on each of said drive shafts, said screw threads mating with each other for transporting and exhausting a gas trapped in said second casing;

and a motor section mounted between said first pump section and said second pump section for driving said pair of drive shafts of said first pump section and said second pump section.

2. A displacement type vacuum pump according to claim 1, wherein said drive shaft is supported by bearings mounted between said motor section and said pump section for supporting said screw rotor in a contileveler manner.

3. A displacement type vacuum pump according to claim 1, wherein said first pump section has an exhaust capacity which is higher than an exhaust capacity of said second pump section.

4. A displacement type vacuum pump according to claim 1, wherein said displacement type vacuum pump does not use a lubricating oil for lubricating said bearings.

5. A displacement type vacuum pump according to claim 1, wherein said a pair of drive shafts are magnetically coupled and rotated synchronously with each other.

6. A displacement type vacuum pump according to claim 1, wherein a gas flow passage is provided inside of said motor section for transporting an exhausted gas from said first pump section to said second pump section.

7. A displacement type vacuum pump according to claim 1, wherein a gas flow passage is provided outside of said motor section for transporting an exhausted gas from said first pump section to said second pump section.

8. A displacement type vacuum pump as claimed in claim 1, wherein a bypass passage is provided for relieving a pressure rise by directing a gas from an inlet of said second pump section to a gas discharge port thereof when an inlet pressure of said second pump section exceeds an outlet pressure thereof.

9. A displacement type vacuum pump according to claim 1, wherein, a control means is provided therewith for reducing rotation speed of said drive shaft so as to keep power consumption substantially constant, when pressure becomes too high to exceed torque ratings of said motor section.

* * * * *